United States Patent [19]

Takahashi et al.

[11] Patent Number: 5,074,973

[45] Date of Patent: Dec. 24, 1991

[54] NON-AQUEOUS ELECTROLYTIC ALUMINUM PLATING BATH COMPOSITION

[75] Inventors: Setsuko Takahashi; Isao Saeki; Kikuko Tanaka; Kayoko Oku, all of Ichikawa; Shoichiro Mori; Kazuhiko Ida, both of Ami; Katsuhiko Ohara; Fujio Matsui, both of Tokyo; Hitoshi Suzuki, Ami, all of Japan

[73] Assignees: Nisshin Steel Co. Ltd.; Mitsubishi Petrochemical Co. Ltd., both of Tokyo; C. Uyemura and Co. Ltd., Osaka, all of Japan

[21] Appl. No.: 540,286

[22] Filed: Jun. 18, 1990

[30] Foreign Application Priority Data

May 23, 1989 [JP] Japan ..... 1-162393
Jun. 23, 1989 [JP] Japan ..... 1-162392

[51] Int. Cl.[5] ..... C25D 3/44
[52] U.S. Cl. ..... 205/234
[58] Field of Search ..... 204/39, 58.5

[56] References Cited

U.S. PATENT DOCUMENTS

| | | | |
|---|---|---|---|
| 2,446,331 | 8/1948 | Hurley | 204/39 |
| 2,446,349 | 8/1948 | Wier | 204/39 |
| 2,446,350 | 8/1948 | Wier | 204/39 |
| 4,747,916 | 5/1988 | Kato | 204/58.5 |
| 4,966,660 | 10/1990 | Setsuko | 204/58.5 |

*Primary Examiner*—T. M. Tufariello
*Attorney, Agent, or Firm*—Webb, Burden, Ziesenheim & Webb

[57] ABSTRACT

There is disclosed a non-aqueous electrolytic aluminum plating bath composition comprising an aluminum halide and a nitrogen-containing heterocyclic onium halide compound and containing an additive selected from the group consisting of an inorganic halide compound, aromatic aldehyde, ketone or carboxylic acid, an unsaturated heterocyclic compound containing more than one nitrogen atom, an unsaturated heterocyclic compound containing a sulfur atom, an aromatic hydrocarbon compound containing a sulfur atom, an aromatic hydrocarbon compound containing an amino group and an aromatic amine; and further optionally an organic polymer. The bath composition is easy in maintenance, has good covering power, and enables smooth plating with low current density.

10 Claims, No Drawings

NON-AQUEOUS ELECTROLYTIC ALUMINUM PLATING BATH COMPOSITION

FIELD OF THE INVENTION

This invention relates to electrolytic aluminum plating bath compositions comprising an aluminum halide, a nitrogen-containing heterocyclic onium halide compound and an inorganic or organic additive.

BACKGROUND OF THE INVENTION

Electrolytic plating of aluminum cannot be conducted in an aqueous system because the affinity of aluminum to oxygen is strong, and the electrolytic potential thereof is baser than hydrogen. Therefore, electrolytic plating of aluminum is conducted in a non-aqueous medium, especially in an organic medium.

Typical among the known organic electrolytic baths for aluminum plating are a bath comprising $AlCl_3$ and $LiAlH_4$ or LiH dissolved in ether and a bath comprising $AlCl_3$ and LiAlH dissolved in tetrahydrofuran (THF). However, these baths contain highly reactive $LiAlH_4$ and LiH, which react with oxygen or moisture, which may be contained in the bath, and may decompose thus deteriorating the electric current efficiency and shortening the bath life.

In order to overcome these disadvantage of the prior art, bath compositions comprising an aluminum halide and an onium salt of a nitrogen-containing heterocyclic compound have been proposed. These include bath compositions obtained by melting and mixing an aluminum halide and an N-alkylpyridinium halide (Japanese Laid-Open Patent Publication No. Sho 62-70592 and Sho 62-70593), a bath composition obtained by melting and mixing an aluminum halide and a 1-alkyl- or 1,3-dialkylimidazolium halide (Japanese Laid-Open Patent Publication No. Hei 1-272790), etc.

These bath compositions are liquid at room temperature and free from the danger of ignition, and if an aluminum anode is used, the bath is continuously replenished with aluminum as the aluminum in the bath is consumed. These bath compositions are more advantageous than other bath compositions in that the maintenance of the bath is easy and thus the operation is simpler.

Recently, electrolytically aluminum-plated products having a thick aluminum coating of no less than 10–50 μm, inter alia, anodized products, are attracting attention as corrosion-resistant materials.

When thick aluminum plating is conducted using any of the above-described bath compositions comprising an aluminum halide and an onium salt of nitrogen-containing heterocyclic compound, however, aluminum is not uniformly deposited but particles thereof grow locally larger, making the surface irregular, and that the particles on the surface may come off under friction. The irregularity of the surface spoils the (surface) luster and, therefore, such products are not suitable to be used as reflectors or the like.

One measure for overcoming the above problems is to add an organic solvent such as benzene, toluene, or the like to the bath in an amount of 1–2 moles per mole aluminum halide. However, addition of such a large amount of organic solvent is not preferable because the solvent deteriorates the working environment by evaporation thereof and, moreover, invites danger of ignition.

Further, the above-described bath compositions are inferior in covering powder and, therefore, when shaped bodies are plated, concaved parts where the current density is not more than 0.01 $A/dm^2$ may not be plated.

The present invention provides an electrolytic aluminum plating bath composition which enables overall, uniform, dense and smooth plating with low current density.

We have found that the above-described problems can be overcome by addition of specific organic heterocyclic compounds, and organic polymers, if desired, to the above-described bath compositions.

SUMMARY OF THE INVENTION

This invention provides a non-aqueous electrolytic aluminum plating bath composition which comprises (1) 40–80 mol % of an aluminum halide, (2) 20–60 mol % of a nitrogen-containing heterocyclic onium halide (a halide of an onium of a nitrogen-containing heterocyclic compound), (3) at least one additive selected from the group consisting of 0.0005–0.05 mol/l of a halide represented by the formula $MX_n$, wherein M is Ag, C, Sn(II), Pb, Sb, S or Se, X is a halogen and n is an integer corresponding to the valency of the M element; 0.0005–0.1 mol/l of an aromatic aldehyde, aromatic ketone, aromatic carboxylic acid or derivative thereof; an unsaturated heterocyclic compound containing more than one nitrogen atom; an unsaturated heterocyclic compound containing a sulfur atom; an aromatic hydrocarbon compound containing a sulfur atom; an aromatic hydrocarbon compound containing an amino group; an aromatic amine and optionally (4) 30 mg/l–1 g/l of an organic polymer.

Aluminum halide is represented by the formula $AlX_3$, wherein X is a halogen atom. Specific examples are $AlF_3$, $AlCl_3$, $AlBr_3$ and $AlI_3$.

The aluminum halide is used in an amount of 40–80 mol % in the plating bath, preferably 50–70 mol % and more preferably 55–67 mol %. In a system where the amount of the aluminum halide is too small, the reaction, which may be considered to be the decomposition of the onium cation, occurs, while in a system where the amount thereof is too large, the viscosity of the bath tends to be increased undesirably.

The nitrogen-containing heterocyclic onium halide used for the bath composition of the present invention is a heterocyclic compound, the nitrogen atom (as the hetero atom) of which forms a cationized ammonium radical. Generally, it comprises a five-membered or six-membered ring. The hetero ring may have substituents or may be comprised of a fused ring. Preferred substituents are alkyl and alkylamino, which preferably contain 1 to 12 carbon atoms.

Specific examples are pyridinium halide such as pyridinium chloride; monoalkylpyridinium halide such as butylpyridinium chloride, etc.; di- and trialkylpyridinium halide such as 1,2-dimethylpyridinium chloride, 1-ethyl-2-methylpyridinium chloride, 1-ethyl-2-methylpyridinium bromide, 1-ethyl-2-methylpyridinium iodide, 1-ethyl-2-methylpyridinium fluoride, 1-n-butyl-2-methylpyridinium chloride, 1-isobutyl-2-methylpyridinium chloride, 1-isobutyl-2-methylpyridinium chloride, 1-n-octyl-2-methylpyridinium chloride, 1-benzyl-2-methylpyridinium chloride, 1-ethyl-3-methylpyridinium chloride, 1-ethyl-3-methylpyridinium bromide, 1-cyclohexyl-3-methylpyridinium bromide, 1-ethyl-2-ethylpyridinium chloride, 1-butyl-2-ethylpyridinium chloride, 1-ethyl-4-methylpyridinium bromide, 1-ethyl-4-phenylpyridinium bromide, 1-ethyl-2,4-dimethylpyridinium chloride, 1-n-butyl-2,4-dimethylpyridinium chloride, etc.; 1-alkyl-aminopyridinium halide such as 1-methyl-4-dimethylaminopyridinium iodide, 1-ethyl-4-dimethylaminopyridinium chloride, 1-ethyl-4-(N -ethyl-N-methyl)aminopyridinium chloride, 1-ethyl-4-aminopyridinium iodide, 1-n-butyl-4-dimethylaminopyridinium fluoride, 1-benzyl-4-dimethylaminopyridinium chloride, 1-n-octyl-4-dimethylaminopyridinium chloride, 1-ethyl-4-piperidinopyridinium bromide, 1-ethyl-4-pyrrolidinopyridinium chloride, 1-ethyl-4-pyrrolidinopyridinium bromide, etc.; imidazolium halides such as imidazolium chloride, etc.; alkylimidazolium halide such as ethylimidazolium chloride, etc.; 1-alkyl, 1,3-dialkyl, 1,2,3-trialkylimidazolium halide such as 1-methylimidazolium bromide, 1-ethylimidazolium chloride, 1-butylimidazolium chloride, 1,3-dimethylimidazolium bromide, 1-methyl-3-ethylimidazolium iodide, 1-methyl-3-n -butylimidazolium chloride, 1-methyl-3-benzylimidazolium chloride, 1-methyl-3-ethylimidazolium chloride, 1,2,3-trimethylimidazolium bromide, 1,2,3-trimethylimidazolium iodide, 1,2-dimethyl-3-ethylimidazolium bromide, 1,2-dimethyl-3-ethylimidazolium chloride, 1,2-dimethyl-3-butylimidazolium chloride, 1,2-dimethyl-3-butylimidazolium fluoride, etc.; dialkylbenzimidazole halide such as 1,3-dimethylbenzimidazolium chloride, 1-methyl-3-ethylbenzimidazolium chloride, 1-methyl-3-ethylbenzimidazolium bromide, 1-methyl-3-ethylbenzimidazolium iodide, etc.

Among these, alkylpyridinium halide and dialkyl imidazolium halide are preferred because they provide the plating bath with high electric conductivity.

The nitrogen-containing heterocyclic compound onium halide is contained in the platinq bath preferably in an amount of 30–50 mol %, more preferably 33–45 mol % in the bath.

Of the halides used in the present invention, halides of Ag, Sn(II), Pb and Sb make the surface of the plated layer smoother although metallic luster is not improved while those of C, S and Se improve metallic luster and surface smoothness. It is preferred to use a metal halide, the halogen atom of which is the same as the halogen atom of the used aluminum halide.

The halide is contained in the plating bath preferably in an amount of 0.0008–0.01 mol/l, more preferably 0.00095–0.0015 mol/l. When the halide content is too small, the surface-smoothing effect is poor while with more than 0.1 mol/l, deposition of eutectoid increases deteriorating corrosion resistance of the plated layer.

Specific examples of the aromatic aldehyde, ketone, carboxylic acid and derivatives thereof are aldehydes such as benzaldehyde, salicylaldehyde, anisaldehydes, etc.; ketones such as acetophenone, benzophenone, etc.; carboxylic acids and derivatives thereof such as phthalic acid, methyl benzoate, etc.

Specific examples of the unsaturated heterocyclic compound containing more than one nitrogen atoms are pyrimidine, naphthylidine, phenazine, phenanthroline, pyridazine, pyrazine, etc.

Specific examples of the unsaturated heterocyclic compound containing a sulfur atom are thiophene, etc.

Specific examples of the aromatic hydrocarbon compound containing a sulfur atom are thiophenol, thiobenzoic acid, etc.

Specific examples of the aromatic hydrocarbon compound containing an amino group are diphenyl amine, aminopyrimidine, etc.

These organic compounds have the effect of improving covering power when plating is effected with low current density and are contained in the plating bath preferably in an amount of 0.001–0.05 mol/l, and more preferably, 0.001–0.01 mol/l. When these organic compound is contained in an amount of more than 0.1 mol/l, burning may be caused when plating is conducted with high current density.

Any organic polymer can be used insofar as it is soluble in the molten salt bath and stable under the plating conditions. The molten salt bath has high dissolving ability and dissolves almost all polymers other than high corrosion-resistant polymers such as fluorine resin. Preferred polymers are ethylene polymers having aromatic substituents or polyethers. Specific examples of ethylene polymers having aromatic substituents are polystyrene, polyvinylcarbazol, etc. These polymers preferably have a molecular weight of 2,700–400,000.

The polymer is added to the plating bath in an amount of 30 mg/l–1 g/l, preferably 30 mg/l–500 mg/l and more preferably 50 mg/l–100 mg/l. When a sufficient amount of the polymer is not contained, covering power is not well improved at the low current density portions and with more than 1 g/l, burning is caused when plating is conducted with high current density.

The plating bath of the present invention comprising an aluminum halide, a nitrogen-containing heterocyclic onium halide and an additional component can be obtained by melting and mixing the above components under an inert atmosphere or suspending the above components in a suitable solvent and mixing them under warming and thereafter removing the solvent.

When plating is carried out with the plating bath of the present invention, plating is effected in a dry oxygen-free atmosphere in the same way as when conventional plating baths are used. Electrolysis is suitably conducted with direct or pulse current with a current density of 0.01–50 A/dm$^2$ at 0–150° C. with good current efficiency effecting uniform plating. At a temperature lower than 0° C., uniform plating is not obtained. At a temperature higher than 150° C., reduction of nitrogen-containing heterocyclic onium is caused giving a grey plating layer and coarse dendritic crystals and thus spoiling the appearance and workability when plating is carried out with a current density of higher than 50 A/dm$^2$.

SPECIFIC DISCLOSURE OF THE INVENTION

Now the invention will be specifically illustrated by way of working examples.

EXAMPLES 1–32

A cold-rolled mild steel sheet having a thickness of 0.5 mm was subjected to ordinary solvent vapor washing, alkali defatting and pickling. After being dried, the sheet was immersed in a molten salt bath of the present invention, the composition of which is indicated in Table 1, and aluminum plating was effected using the steel sheet as the cathode and an aluminum plate (99.99% pure, 1 mm thick) as the anode under the electrolysis conditions as indicated in Table 1. The results are also shown in Table 1.

COMPARATIVE EXAMPLE 1

Aluminum plating of cold-rolled mild steel sheet was carried out with a plating bath consisting of $AlCl_3$ and butylpyridinium chloride. The bath composition, plating conditions and the results are shown in Table 1.

COMPARATIVE EXAMPLE 2

Aluminum plating of cold-rolled mild steel sheet was carried out with a plating bath consisting of $AlCl_3$ and 1-ethyl-3-methylimidazolium chloride. The bath composition and the results are shown in Table 1.

EXAMPLES 33–44

Molten baths comprising an aluminum halide, a nitrogen-containing heterocyclic onium halide compound, an unsaturated heterocyclic compound and an organic polymer, the compositions of which are shown in Table 2–1, were prepared. Using these plating baths, 0.5 mm thick cold-rolled mild steel sheets were electrolytically plated with aluminum. The plating was effected by washing the cold-rolled mild steel sheets with solvent vapor in accordance with the usual procedure, defatting them with alkali, pickling and drying them, immersing them in a plating bath and carrying out electrolysis using a cold-rolled steel sheet as the cathode and an aluminum plate (99.99% pure, 1 mm thick) as the anode with direct current under the conditions indicated in Table 2—2. The properties of the plated products are also shown in Table 2—2.

COMPARATIVE EXAMPLES 3 AND 4

Electrolytic aluminum plating was carried out using the baths under the conditions as indicated in Table 2–1, i.e. without any additive and polymer The results are also shown in Table 2—2.

As has been described above, the plating bath composition which comprises an aluminum halide, a nitrogen-containing heterocyclic onium halide compound, and a specified additive and optionally organic polymer has better covering power, gives plated layers having smoother surface.

TABLE 1-1

| | | Bath Composition | | | Conditions of Electrolysis | | | | | Plated layer | | |
|---|---|---|---|---|---|---|---|---|---|---|---|---|
| | Run No. | $AlX_3$ | Nitrogen-containing heterocyclic onium halide | Additive | Temp. (°C.) | Current density ($A/dm^2$) | Time (min) | Atmosphere | Current efficiency (%) | Thickness (μm) | X'l | Workability |
| Working Examples | 1 | $AlCl_3$ 60 mol % | Butylpyridinium chloride 40 mol % | AgCl 0.001 mol/l | 40 | 10 | 15 | $N_2$ gas | 98 | 30 | Dense, Non-lustrous | Good |
| | 2 | $AlBr_3$ 55 mol % | Methylpyridinium bromide 45 mol % | $SnBr_2$ 0.001 mol/l | 60 | 20 | 10 | Ar gas | 98 | 40 | Dense, Lustrous | Good |
| | 3 | $AlF_3$ 60 mol % | Ethylpyridinium fluoride 40 mol % | $S_2Cl_2$ 0.001 mol/l | 80 | 30 | 10 | Ar gas | 97 | 60 | Dense, Lustrous | Good |
| | 4 | $AlCl_3$ 67 mol % | Butylpyridinium chloride 33 mol % | $CCl_4$ 0.001 mol/l | 60 | 20 | 10 | $N_2$ gas | 98 | 40 | Dense, Lustrous | Good |
| | 5 | $AlCl_3$ 67 mol % | Butylpyridinium chloride 33 mol % | $PbCl_2$ 0.001 mol/l | 60 | 20 | 10 | $N_2$ gas | 98 | 40 | Dense, Non-lustrous | Good |
| | 6 | $AlCl_3$ 67 mol % | Butylpyridinium chloride 33 mol % | $SbCl_4$ 0.001 mol/l | 60 | 20 | 10 | $N_2$ gas | 99 | 40 | Dense, Non-lustrous | Good |
| | 7 | $AlCl_3$ 67 mol % | Butylpyridinium chloride 33 mol % | SeCl 0.001 mol/l | 60 | 20 | 10 | $N_2$ gas | 99 | 40 | Dense, Lustrous | Good |
| | 8 | $AlCl_3$ 60 mol % | Butylpyridinium chloride 40 mol % | Thiophene 0.01 mol/l | 60 | 20 | 10 | $N_2$ gas | 100 | 40 | Dense, Non-lustrous | Good |
| | 9 | $AlCl_3$ 65 mol % | Butylpyridinium chloride 35 mol % | Thiophenol 0.01 mol/l | 60 | 20 | 10 | $N_2$ gas | 98 | 40 | Dense, Non-lustrous | Good |

TABLE 1-2

| | | Bath Composition | | | Conditions of Electrolysis | | | | | Plated layer | | |
|---|---|---|---|---|---|---|---|---|---|---|---|---|
| | Run No. | $AlX_3$ | Nitrogen-containing heterocyclic onium halide | Additive | Temp. (°C.) | Current density ($A/dm^2$) | Time (min) | Atmosphere | Current efficiency (%) | Thickness (μm) | X'l | Workability |
| Working Examples | 10 | $AlCl_3$ 65 mol % | Butylpyridinium chloride 35 mol % | Aniline 0.005 mol/l | 60 | 0.05 | 120 | $N_2$ gas | 98 | 1.2 | Dense, Non-lustrous | Good |
| | 11 | $AlCl_3$ 65 mol % | Butylpyridinium chloride 35 mol % | Pyrimidine 0.001 mol/l | 60 | 30 | 10 | $N_2$ gas | 99 | 60 | Dense, Lustrous | Good |
| | 12 | $AlCl_3$ 65 mol % | Butylpyridinium chloride 35 mol % | Amino-pyrimidine 0.005 mol/l | 60 | 30 | 10 | $N_2$ gas | 99 | 60 | Dense, Lustrous | Good |
| | 13 | $AlCl_3$ 65 mol % | Butylpyridinium chloride 35 mol % | Benzaldehyde 0.01 mol/l | 60 | 30 | 10 | $N_2$ gas | 99 | 60 | Dense, Non-lustrous | Good |
| | 14 | $AlCl_3$ | Butylpyridinium | Benzo- | 60 | 30 | 10 | $N_2$ gas | 99 | 60 | Dense, | Good |

TABLE 1-2-continued

| | Run No. | Bath Composition: $AlX_3$ | Nitrogen-containing heterocyclic onium halide | Additive | Conditions of Electrolysis: Temp. (°C.) | Current density ($A/dm^2$) | Time (min) | Atmosphere | Current efficiency (%) | Plated layer: Thickness (μm) | X'l | Workability |
|---|---|---|---|---|---|---|---|---|---|---|---|---|
| | | 65 mol % | chloride 35 mol % | phenone 0.01 mol/l | | | | | | | Non-lustrous | |
| | 15 | $AlCl_3$ 65 mol % | Butylpyridinium chloride 35 mol % | Phthalic acid 0.005 mol/l | 60 | 30 | 10 | $N_2$ gas | 98 | 60 | Dense, Lustrous | Good |
| | 16 | $AlCl_3$ 67 mol % | Butylpyridinium chloride 33 mol % | Amino-pyrimidine 0.003 mol/l | 60 | 30 | 10 | $N_2$ gas | 99 | 60 | Dense, Lustrous | Good |
| Comparative Example | 1 | $AlCl_3$ 65 mol % | Butylpyridinium chloride 35 mol % | — | 60 | 10 | 15 | $N_2$ gas | 98 | — | Surface remarkably rough | |

TABLE 1-3

| | Run No. | Bath Composition: $AlX_3$ | Nitrogen-containing heterocyclic onium halide | Additive | Conditions of Electrolysis: Temp. (°C.) | Current density ($A/dm^2$) | Time (min) | Atmosphere | Current efficiency (%) | Plated layer: Thickness (μm) | X'l | Workability |
|---|---|---|---|---|---|---|---|---|---|---|---|---|
| Working Examples | 17 | $AlCl_3$ 60 mol % | 1-Ethylimidazolium chloride 40 mol % | AgCl 0.001 mol/l | 60 | 10 | 15 | $N_2$ gas | 98 | 30 | Dense, Non-lustrous | Good |
| | 18 | $AlBr_3$ 65 mol % | 1-Octylimidazolium bromide 35 mol % | $SnBr_2$ 0.001 mol/l | 40 | 30 | 10 | Ar gas | 99 | 60 | Dense, Lustrous | Good |
| | 19 | $AlF_3$ 60 mol % | 1-Ethyl-3-methylimidazolium fluoride 40 mol % | $S_2Cl_2$ 0.001 mol/l | 60 | 10 | 30 | $N_2$ gas | 100 | 60 | Dense, Lustrous | Good |
| | 20 | $AlCl_3$ 67 mol % | Butylpyridinium chloride 33 mol % | $CCl_4$ 0.001 mol/l | 60 | 20 | 10 | $N_2$ gas | 98 | 40 | Dense, Lustrous | Good |
| | 21 | $AlCl_3$ 67 mol % | Butylpyridinium chloride 33 mol % | $PbCl_2$ 0.001 mol/l | 60 | 20 | 10 | $N_2$ gas | 98 | 40 | Dense, Non-lustrous | Good |
| | 22 | $AlCl_3$ 67 mol % | Butylpyridinium chloride 33 mol % | $SbCl_4$ 0.001 mol/l | 60 | 20 | 10 | $N_2$ gas | 99 | 40 | Dense, Non-lustrous | Good |
| | 23 | $AlCl_3$ 67 mol % | Butylpyridinium chloride 33 mol % | SeCl 0.001 mol/l | 60 | 20 | 10 | $N_2$ gas | 99 | 40 | Dense, Lustrous | Good |
| | 24 | $AlCl_3$ 65 mol % | 1,3-Diethylimidazolium chloride 35 mol % | Thiophene 0.01 mol/l | 40 | 15 | 10 | $N_2$ gas | 99 | 30 | Dense, Non-lustrous | Good |
| | 25 | $AlCl_3$ 60 mol % | 1-Butyl-3-propylimidazolium chloride 40 mol % | Thiophenol 0.01 mol/l | 80 | 30 | 5 | Ar gas | 98 | 30 | Dense, Non-lustrous | Good |

TABLE 1-4

| | Run No. | Bath Composition: $AlX_3$ | Nitrogen-containing heterocyclic onium halide | Additive | Conditions of Electrolysis: Temp. (°C.) | Current density ($A/dm^2$) | Time (min) | Atmosphere | Current efficiency (%) | Plated layer: Thickness (μm) | X'l | Workability |
|---|---|---|---|---|---|---|---|---|---|---|---|---|
| Working Examples | 26 | $AlCl_3$ 55 mol % | 1,3-Diethylimidazolium chloride 45 mol % | Aniline 0.005 mol/l | 60 | 0.05 | 120 | Ar gas | 99 | 1.2 | Dense, Non-lustrous | Good |
| | 27 | $AlCl_3$ 65 mol % | 1-Ethyl-3-methylimidazolium chloride 35 mol % | Pyrimidine 0.001 mol/l | 60 | 50 | 3 | $N_2$ gas | 99 | 30 | Dense, Lustrous | Good |
| | 28 | $AlCl_3$ 65 mol % | 1-Ethyl-3-methylimidazolium chloride 35 mol % | Amino-pyrimidine 0.005 mol/l | 60 | 50 | 3 | $N_2$ gas | 98 | 30 | Dense, Lustrous | Good |
| | 29 | $AlCl_3$ 65 mol % | 1-Ethyl-3-methylimidazolium chloride 35 mol % | Benzaldehyde 0.01 mol/l | 60 | 50 | 3 | $N_2$ gas | 99 | 30 | Dense, Non-lustrous | Good |
| | 30 | $AlCl_3$ 65 mol % | 1-Ethyl-3-methylimidazolium | Benzophenone | 60 | 50 | 3 | $N_2$ gas | 99 | 30 | Dense, Non- | Good |

TABLE 1-4-continued

| | Run No. | Bath Composition: $AlX_3$ | Nitrogen-containing heterocyclic onium halide | Additive | Conditions of Electrolysis: Temp. (°C.) | Current density ($A/dm^2$) | Time (min) | Atmosphere | Current efficiency (%) | Plated layer: Thickness (μm) | X'l | Workability |
|---|---|---|---|---|---|---|---|---|---|---|---|---|
| | | | chloride 35 mol % | 0.01 mol/l | | | | | | | lustrous | |
| | 31 | $AlCl_3$ 65 mol % | Butylpyridinium chloride 35 mol % | Phthalic acid 0.005 mol/l | 60 | 50 | 3 | $N_2$ gas | 98 | 30 | Dense, Lustrous | Good |
| | 32 | $AlCl_3$ 67 mol % | Butylpyridinium chloride 33 mol % | Amino-pyrimidine 0.003 mol/l | 60 | 50 | 3 | $N_2$ gas | 99 | 30 | Dense, Lustrous | Good |
| Comparative Example | 2 | $AlCl_3$ 65 mol % | 1-Ethyl-3-methyl-imidazolium chloride 35 mol% | — | 60 | 50 | 3 | $N_2$ gas | — | — | Burning caused | |

TABLE 2-1

| | Run No. | Bath composition: Aluminum halide | Nitrogen-containing heterocyclic onium halide compound | Additive | Organic Polymer |
|---|---|---|---|---|---|
| Working Examples | 33 | $AlCl_3$ 60 mol % | Butylpyridinium chloride 40 mol % | Pyrimidine 0.001 mol/l | Polystyrene 100 mg/l |
| | 34 | $AlCl_3$ 65 mol % | Butylpyridinium chloride 35 mol % | Naphthylidine 0.003 mol/l | Polystyrene 50 mg/l |
| | 35 | $AlCl_3$ 65 mol % | Butylpyridinium chloride 35 mol % | Phenazine 0.005 mol/l | EO-PO copolymer 100 mg/l |
| | 36 | $AlCl_3$ 65 mol % | Butylpyridinium chloride 35 mol % | Phenanthroline 0.003 mol/l | EO-PO copolymer 500 mg/l |
| | 37 | $AlCl_3$ 65 mol % | Butylpyridinium chloride 40 mol % | Diphenylamine 0.01 mol/l | Polystyrene 100 mg/l |
| | 38 | $AlCl_3$ 65 mol % | Butylpyridinium chloride 35 mol % | Aminopyrimidine 0.01 mol/l | EO-PO copolymer 100 mg/l |
| | 39 | $AlCl_3$ 60 mol % | 1-Ethylimidazolium chloride 40 mol % | Pyrimidine 0.001 mol/l | Polystyrene 100 mg/l |
| | 40 | $AlCl_3$ 65 mol % | 1-Ethyl-3-methylimidazolium chloride 35 mol % | Naphthylidine 0.003 mol/l | Polystyrene 50 mg/l |
| | 41 | $AlCl_3$ 65 mol % | 1-Ethyl-3-methylimidazolium chloride 35 mol % | Phenazine 0.005 mol/l | EO-Po copolymer 100 mg/l |
| | 42 | $AlCl_3$ 65 mol % | 1-Ethyl-3-methylimidazolium chloride 35 mol % | Phenanthroline 0.003 mol/l | EO-PO copolymer 500 mg/l |
| | 43 | $AlCl_3$ 65 mol % | 1-Ethyl-3-methylimidazolium chloride 35 mol % | Diphenylamine 0.01 mol/l | Polystyrene 100 mg/l |
| | 44 | $AlCl_3$ 65 mol % | 1-Ethyl-3-methylimidazolium chloride 35 mol % | Aminopyrimidine 0.01 mol/l | EO-PO copolymer 100 mg/l |
| Comparative Examples | 3 | $AlCl_3$ 65 mol % | Butylpyridinium chloride 35 mol % | — | — |
| | 4 | $AlCl_3$ 65 mol % | 1-Ethyl-3-methylimidazolium chloride 35 mol % | — | — |

EO = ethylene oxide
PO = propylene oxide

TABLE 2-2

| | Run No. | Conditions of Electrolysis: Temp. (°C.) | Current density ($A/dm^2$) | Time (min) | Atmosphere | Current efficiency (%) | Plated layer: Thickness (μm) | X'l | Workability |
|---|---|---|---|---|---|---|---|---|---|
| Working Examples | 33 | 60 | 0.05 | 120 | $N_2$ gas | 98 | 1.2 | Dense, Non-lustrous Smooth, good covering power | Good |
| | 34 | 60 | 30 | 10 | $N_2$ gas | 99 | 60 | Dense, Lustrous Good covering power | Good |
| | 35 | 60 | 30 | 10 | $N_2$ gas | 99 | 60 | Dense, Lustrous Good covering power | Good |
| | 36 | 60 | 0.05 | 120 | $N_2$ gas | 98 | 1.2 | Dense, Non-lustrous Smooth, good covering power | Good |
| | 37 | 60 | 30 | 10 | $N_2$ gas | 99 | 60 | Dense, Non-lustrous Smooth, good covering power | Good |
| | 38 | 60 | 0.05 | 120 | $N_2$ gas | 98 | 1.2 | Dense, Non-lustrous Smooth, good covering power | good |
| | 39 | 60 | 0.05 | 120 | Ar gas | 99 | 1.2 | Dense, Non-lustrous Smooth, good covering power | Good |
| | 40 | 60 | 50 | 3 | $N_2$ gas | 99 | 30 | Dense, Lustrous Good covering power | Good |
| | 41 | 60 | 50 | 3 | $N_2$ gas | 99 | 30 | Dense, Lustrous Good covering power | Good |

TABLE 2-2-continued

| | Run No. | Conditions of Electrolysis: Temp. (°C.) | Current density ($A/dm^2$) | Time (min) | Atmosphere | Current efficiency (%) | Plated layer: Thickness (μm) | X'l | Workability |
|---|---|---|---|---|---|---|---|---|---|
| | 42 | 60 | 0.05 | 120 | $N_2$ gas | 98 | 1.2 | Dense, Non-lustrous Smooth, good covering power | Good |
| | 43 | 60 | 50 | 3 | $N_2$ gas | 99 | 30 | Dense, Non-lustrous Smooth, good covering power | good |
| | 44 | 60 | 0.05 | 120 | $N_2$ gas | 98 | 1.2 | Dense, Non-lustrous Smooth, good covering power | Good |
| Comparative Example | 3 | 60 | 30 | 10 | $N_2$ gas | 98 | 60 | Rough surface, Poor covering power | |
| | 4 | 60 | 30 | 10 | $N_2$ gas | 98 | 60 | Rough surface, Poor covering power | |

We claim:

1. A non-aqueous electrolytic aluminum plating bath composition which comprises:

(1) 40–80 mol % of an aluminum halide, (2) 20–60 mol % of a nitrogen-containing heterocyclic onium halide, (3) an additive selected from:

0.0005–0.05 mol/l of a halide compound represented by the formula $MX_n$, wherein M is Ag, C, Sn(II), Pb, Sb, S or Se, X is a halogen atom and n is an integer corresponding to the valency of the M element; and 0.0005–0.1 mol/l of an organic compound selected from a group consisting of an aromatic aldehyde, aromatic ketone, aromatic carboxylic acid or derivatives thereof; an unsaturated heterocyclic compound containing more than one nitrogen atom; an unsaturated heterocyclic compound containing a sulfur atom; an aromatic hydrocarbon compound containing a sulfur atom; an aromatic hydrocarbon compound containing an amino group and an aromatic amine, and optionally (4) 30 mg/l–1 g/l of an organic polymer.

2. The composition as claimed in claim 1, wherein the aluminum halide is one of bromide, chloride and fluoride.

3. The composition as claimed in claim 1, wherein the nitrogen-containing heterocyclic onium halide is an N-alkylpyridinium halide or a (di)alkylimidazolium halide.

4. The composition as claimed in claim 1, wherein the nitrogen-containing heterocyclic onium halide is a compound selected from the group consisting of butylpyridinium chloride, methylpyridinium bromide, ethylpyridinium fluoride, 1-ethylimidazolium chloride, 1-octylimidazolium bromide, 1-ethyl-3-methylimidazolium fluoride, 1-butyl-3-propylimidazolium chloride, 1,3-diethylimidazolium chloride and 1-ethyl-3-methylimidazolium chloride.

5. The composition as claimed in claim 1, wherein the additive is selected from the group consisting of AgCl, $SnBr_2$, $CCl_4$, $PbCl_2$, $SbCl_4$, SeCl, thiophene, thiophenol, aniline, pyridine, aminopyridine, benzaldehyde, benzophenone, phthalic acid, pyrimidine, naphthylidine, phenazine, diphenylamine and phenanthroline.

6. The composition as claimed in claim 1, wherein the organic polymer is contained.

7. The composition as claimed in claim 6, wherein the organic polymer is selected from the group consisting of polystyrene and ethylene oxide-propylene oxide copolymer.

8. The composition as claimed in claim 1, wherein the content of the aluminum halide is 50–70 mol % and the content of the nitrogen-containing heterocyclic onium halide content is 30–50 mol %.

9. The composition as claimed in claim 1, wherein the content of the compound $MX_n$ is 0.001–0.05 mol/l, the content of the aromatic aldehyde, aromatic ketone, aromatic carboxylic acid; the unsaturated heterocyclic compound; the unsaturated heterocyclic compound containing a sulfur atom; the aromatic hydrocarbon compound containing a sulfur atom; or the aromatic hydrocarbon compound containing an amino group is 0.001–0.05 mol/l.

10. The composition as claimed in claim 6, wherein the organic polymer content is 0.03–0.5 g/l.

* * * * *

UNITED STATES PATENT AND TRADEMARK OFFICE

CERTIFICATE OF CORRECTION

PATENT NO. : 5,074,973

DATED : December 24, 1991

INVENTOR(S) : Setsuko Takahashi et al.

It is certified that error appears in the above-identified patent and that said Letters Patent is hereby corrected as shown below:

Title page, under Foreign Application Priority Data
"May 23, 1989 [JP] Japan ... 1-162393" should read
--June 23, 1989 [JP] Japan ... 1-162393--.

Column 1 Line 28 "disadvantage" should read --disadvantages--.

Column 3 Line 61 "atoms" should read --atom--.

Column 4 Line 9 "these" should read --this--.

Column 6 Line 14 after "polymer" insert --.--.

Table 2-1, Run No. 41, under Organic Polymer, Column 10
"EO-Po copolymer" should read --EO-PO copolymer--.

Signed and Sealed this

Eighth Day of March, 1994

*Attest:*

Bruce Lehman

BRUCE LEHMAN

*Attesting Officer*

*Commissioner of Patents and Trademarks*